US009937373B2

(12) United States Patent
Gvoich

(10) Patent No.: US 9,937,373 B2
(45) Date of Patent: Apr. 10, 2018

(54) METHOD AND APPARATUS FOR MULTI-PURPOSE BOX TRAINING SYSTEM

(71) Applicant: GVOICH FITNESS SYSTEMS, Baton Rouge, LA (US)

(72) Inventor: William Gvoich, Baton Rouge, LA (US)

( * ) Notice: Subject to any disclaimer, the term of this patent is extended or adjusted under 35 U.S.C. 154(b) by 0 days.

(21) Appl. No.: 15/068,207

(22) Filed: Mar. 11, 2016

(65) Prior Publication Data

US 2016/0263421 A1 Sep. 15, 2016

Related U.S. Application Data

(60) Provisional application No. 62/132,576, filed on Mar. 13, 2015.

(51) Int. Cl.

| | |
|---|---|
| ***A63B 21/06*** | (2006.01) |
| ***A63B 21/00*** | (2006.01) |
| *A63B 21/075* | (2006.01) |
| *A63B 21/072* | (2006.01) |
| *A63B 23/035* | (2006.01) |

(52) U.S. Cl.

CPC ..... *A63B 21/0605* (2013.01); *A63B 21/072* (2013.01); *A63B 21/4035* (2015.10); *A63B 21/075* (2013.01); *A63B 21/0724* (2013.01); *A63B 21/0726* (2013.01); *A63B 21/0728* (2013.01); *A63B 23/03508* (2013.01); *A63B 23/03525* (2013.01); *A63B 23/03541* (2013.01)

(58) Field of Classification Search

CPC ..... A63B 21/0605; A63B 21/4035; A63B 21/072; A63B 21/0726; A63B 21/075; A63B 21/0728; A63B 21/0724; A63B 23/03508; A63B 23/03525; A63B 23/03541; A63B 71/0036; A45C 5/00

USPC ..... 206/315.1, 493

See application file for complete search history.

(56) References Cited

U.S. PATENT DOCUMENTS

| | | | | |
|---|---|---|---|---|
| 4,431,185 A * | 2/1984 | Cisneros | A63B 21/072 | 220/318 |
| 5,102,124 A * | 4/1992 | Diodati | A63B 21/0605 | 482/106 |
| 6,123,651 A * | 9/2000 | Ellenburg | A63B 71/0036 | 482/104 |
| 7,011,611 B1 * | 3/2006 | Ripley | A63B 21/0728 | 482/107 |
| 7,201,711 B2 * | 4/2007 | Towley, III | A63B 21/0605 | 482/106 |
| 7,458,920 B2 * | 12/2008 | Hallar | A63B 21/06 | 206/303 |
| 9,550,088 B2 * | 1/2017 | Coompol | A63B 21/0724 | |

* cited by examiner

*Primary Examiner* — Loan H Thanh
*Assistant Examiner* — Megan Anderson
(74) *Attorney, Agent, or Firm* — Ted M. Anthony

(57) ABSTRACT

A multi-purpose box training system apparatus that is designed to enable a user to train his or her entire body in an effective and safe manner.

3 Claims, 13 Drawing Sheets

METHOD AND APPARATUS FOR MULTI-PURPOSE BOX TRAINING SYSTEM

CROSS REFERENCES TO RELATED APPLICATION

Priority of U.S. Provisional Patent Application Ser. No. 62/132,576, filed Mar. 13, 2015, Incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for use in strength and fitness conditioning. More particularly, the present invention pertains to a multi-functional training apparatus and method that permits versatile training with key exercises in an effective and functionally progressive manner using a single device.

2. Brief Description of the Prior Art

Muscular strength and endurance play an important role in enabling a person to perform physical activity that said person may encounter in any number of different circumstances including, without limitation, at work, home, an outdoor setting, or while participating in a sporting activity. However, due to a recent epidemic of inactivity and obesity in many adults and children, many people have lost the ability to effectively perform certain basic physical functions that enable people to effectively carry out daily physical demands of everyday life. As a result, this can have a detrimental effect on a person in a variety of ways, such as, for example, by creating muscle imbalance and physical weakness, increasing the chance of an injury, and causing a change in body composition due to a loss of muscle mass.

Conventional exercise and strength-training equipment that can be found in gyms and fitness facilities, suffer from a design deficiency. Most conventional exercise and strength-timing equipment has a fixed movement or motion, which is dictated by a machine that is generally unable to mimic a particular body movement used in a normal physical activity. Further, most exercises are completed in a sitting position, which generally weakens core muscles of the body (abdominal, lower back, and hips) that are needed in order to perform exercises effectively and safely from a standing position, with correct posture and body alignment. However, different muscles and muscle groups within the human body do not work in isolation of each other—multiple muscles work in tandem, as a team. As a result, conventional exercise machines and strength-training equipment will not correct a weak link in a kinetic chain, when multiple muscles within the human body work in sequence to perform a physical task. Instead, conventional exercise machines and strength-training equipment generally isolate a muscle group, and therefore, are unable to address weak link(s) in total body muscle integration, as required for functional strength.

Generally, in order to maximize a transfer benefits that are gained in a gym setting to another activity, such as, for example, a playing field or common activities of daily life, a person must: use a muscle group in a manner that approximates a real life activity; engage deep core muscle groups (such as, deep abdominals, lower back, and hip muscles); perform movements on a variety of different planes of motion and ranges of motion; perform multiple movements in a standing position (not a seated position); and, perform movements that are functionally progressive in order to accommodate a variety of function levels of multiple individuals.

Thus, there is a need for a versatile strength-training and fitness apparatus, and associated method of using same, that can better prepare the human body for real-world physical demands. The apparatus should be inexpensive, easy to use and effective. Further, the apparatus should permit a user to train multiple different muscle groups—and ideally a whole body—in a safe and effective manner.

SUMMARY OF THE INVENTION

The present invention comprises a multi-purpose training apparatus, and method of using same, that provides an innovative approach to functional exercise (in order to improve athletic performance and to better prepare a human body for real-life physical demand.) The box training apparatus of the present enables a user to train his or her entire body by using a plurality of key exercises in an effective, safe, and functionally progressive manner.

The box training apparatus comprises a box member, having a plurality of side members and a back member cooperating to form an inner chamber. Back member comprises a substantially rigid rod member that perpendicularly extends into inner chamber of box member in order to allow at least one weight plate(s), or any other additional source of weight or resistance, to be received on said rod member. Further, side members comprise a plurality of apertures that allow a user to be able to hold said box training assembly in a variety of different positions and/or hand grips. Additionally, the box training apparatus comprises a plurality of dowel members—a first dowel member and a second dowel member—for use in allowing a user to perform alternate exercise movements, with either one box training apparatus or with multiple box training assemblies.

The box training apparatus of the present invention permits a user to transfer a fitness result that can be produced in a gym setting to a real-life activity. The box training apparatus of the present invention comprises a relatively comfortable design that a user can identify with, thereby instilling a sense of familiarity when a user is being introduced to a new skill. In addition, the box training apparatus has an appearance that is different from a conventional exercise machine, dumb bell, bar bell, or other conventional exercise equipment, thereby lowering an intimidation factor that a user could face when using a conventional exercise machine or a free weight typically found in a gym setting.

The present invention represents an improvement over a conventional exercise and strength-training technology because it utilizes a multi-purpose design and function, thereby allowing for whole-body training using a simple, safe, and multi-functional exercise device. The box training system apparatus has a variety of grip and dowel member options that allow a user to progress through a range of activity-based exercises without having to use multiple devices or machines. Therefore, the present invention provides a user with a functional capacity beyond that which is provided by existing exercise and strength-training devices.

The box training apparatus of the present invention can beneficially be used by an individual with or without an instructor. When an individual uses the apparatus without an instructor, a manual or access to an online training tutorial can provide the user with guidance on how to properly use said box training apparatus, and how to perform various exercises with said box training apparatus.

The present invention can also be used by multiple individuals in a group setting, such as, for example, in an exercise class, in a fitness center, or any other group setting. When the apparatus is used in a group exercise class, an instructor of the group exercise class can be beneficially certified in training with said box training apparatus. A certified instructor of a group exercise class can lead a series of exercises using the box training apparatus in order to provide the class participants with a complete body workout. Said instructors can employ various exercises based on whether emphasis is placed on a particular group of muscles, or whether the focus is on balance, strength, or cardio conditioning. As a result, use of the box training apparatus of the present invention increases a user's range of motion in exercise performance, improves a user's functional strength, and corrects muscle weakness that can inhibit a user's performance of a physical movement.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
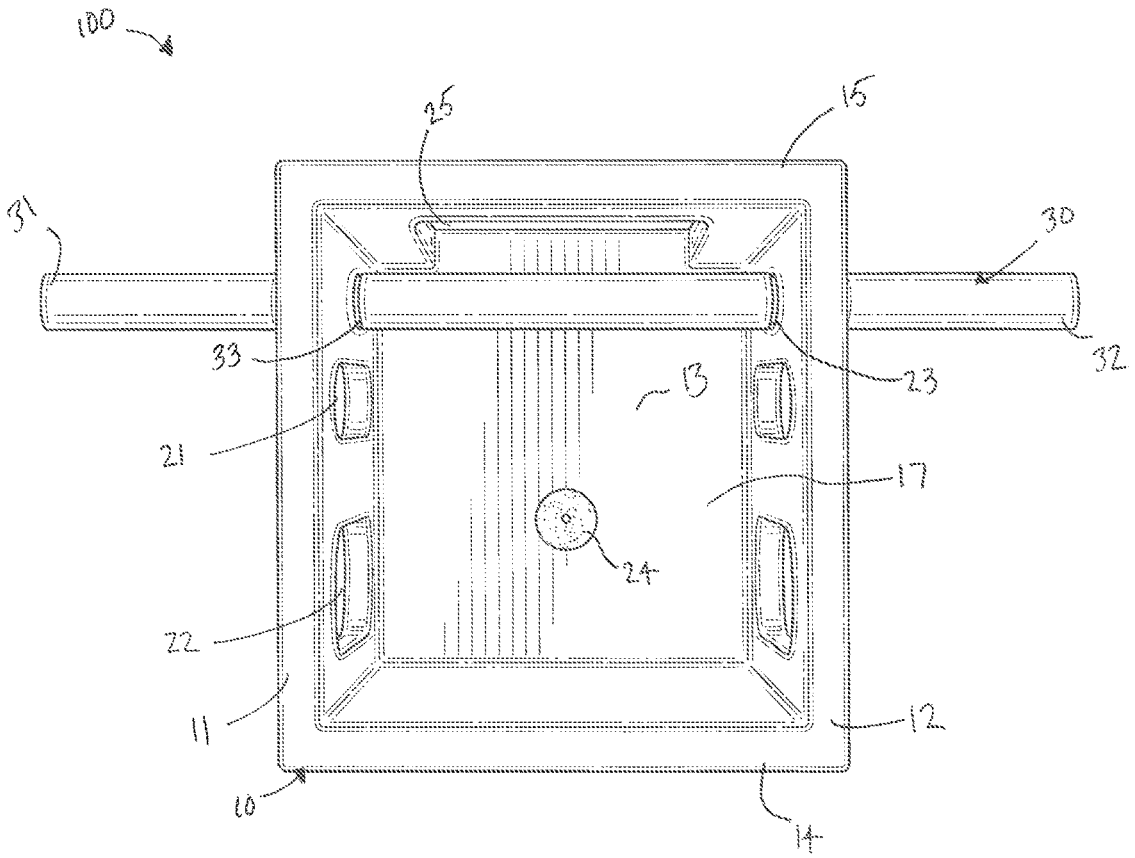
FIG. 1 depicts a front view of a preferred embodiment of a box training apparatus of the present invention with a short dowel member received within aligned circular apertures.

Referring to the drawings, FIG. 1 depicts an end view of a box training assembly 100 of the present invention generally comprising box member 10. Box training assembly 100 of the present invention can be manufactured in a variety of different dimensions; in a preferred embodiment, said box training assembly 100 has dimensions that are relatively wide enough to provide stability and safety to an average human body while permitting ease of movement by a user. Further, box training assembly 100 of the present invention can be manufactured from a rigid structural material, such as, for example, a wooden material, or any other substantially rigid material exhibiting desired strength characteristics.

In a preferred embodiment, box member of box training assembly 100 comprises a plurality of substantially planar panels that are connected via a bolt(s) 19, fasteners, adhesive or any other attachment means. Still referring to FIG. 1, box member 10 generally comprises substantially planar side members 14 and 15 and planar side members 11 and 12. Side members 14 and 15 are hereinafter referred to as "base" member 14 and "top" member 15 for ease and clarification, although it is to be observed that any one of side members 11, 12, 14, or 15 can be used as a base or foundation to rest box training assembly 100 on a ground surface. Said side members 11 and 12 are oriented in a substantially parallel configuration relative to each other, wherein a first side member 11 and a second side member 12 are oriented in a substantially parallel configuration to each other. Back member 13 is oriented in a substantially perpendicular configuration to said first side member 11 and second side member 12. Base member 14 and top member 15 are oriented substantially parallel to each other; said base 14, top 15, and sides 11 and 12, and back member 13 cooperate to form an inner space or chamber 17 for receiving a plurality of weights or any other additional weight sources.

Additionally, although not depicted in FIG. 1, chamber 17 of box member 10 can also be used to store any other additional sources of weight or resistance. Further, box member 10 is self-contained, and thus, chamber 17 can be used to store additional materials (such as, for example, gloves, weight belts, or any other weight-lifting accessory) when box training apparatus 100 is not in use.

In a preferred embodiment, first and second side members 11, 12 each comprise a plurality of apertures 20, wherein apertures 20 can be arranged in a variety of different configurations (such as, for example, an elongate shape or a circular shape) that allow a user to be able to hold box training assembly 100 of the present invention in a variety of different positions and hand grips.

For example, still referring to FIG. 1, in a preferred embodiment, first and second side members 11, 12 each comprise a plurality of elongate slots, or hand grips—a first hand grip 21 and a second hand grip 22. First side member 11 comprises first hand grip 21 that is relatively smaller than second hand grip 22, thereby allowing a user's fingers to fit comfortably into a space of the relatively smaller elongate slot of first hand grip 21. Additionally, first side member 11 comprises second hand grip 22 that is relatively larger than first hand grip 21, thereby allowing a user's thumb and palm to fit comfortably into a space of the relatively larger elongate slot 22 in order for said user's wrist to be in a substantially straight line with respect to said user's forearm.

Further, in a preferred embodiment, second side member 12 also comprises first hand grip 21 that is relatively smaller than second hand grip 22, thereby allowing a user's fingers to fit comfortably within a space of smaller first elongate hand grip 21. Second side member 12 also comprises second hand grip 22 that is relatively larger than first hand grip 21, thereby allowing a user's thumb and palm to fit comfortably into a space of relatively larger elongate slot 22 in order for said user's wrist to be in a substantially straight line with respect to said user's forearm. Thus, first and second elongate slots 21 and 22 on first and second side members 11 and 12, respectively, allow for a user to hold box training assembly 100 of the present invention in a neutral grip hand position, wherein a user's palms are facing each other during exercise performance. Thus, a neutral grip hand position can provide safety, efficiency, and exercise versatility to said user during an exercise movement.

Further, in a preferred embodiment, first and second side members 11 and 12 each have at least one substantially circular aperture 23. Circular aperture 23 of said first and second side members 11 and 12 are aligned to allow for a dowel member (described below) to be slidably received through said aligned apertures 23, thereby permitting use of said dowel as an additional hand grip for box training assembly 100 of the present invention. Additionally, circular aperture 23 is positioned toward a side edge of each of said first and second side members 11 and 12, thereby allowing a user to hold box training assembly 100 of the present invention (when a dowel is inserted) closer to his or her body, thus mimicking a more natural, anatomically beneficial standing position for a human body.

As depicted in FIG. 1, box member 10 generally comprises rod member 24 that is attachably mounted to back member 13 of box member 10 via a threaded bolt 18, or any other secure attachment means. Rod member 24 comprises a substantially cylindrical configuration and is manufactured from a relatively rigid material, such as, for example, wood, metal, composite or any other material exhibiting desired strength and rigidity characteristics. Further, rod member 24 beneficially provides for a means for permitting a user to add at least one weight plate(s) for a variety of strength levels, thereby allowing for a system of progressive variation (increase or decrease) in weight resistance.

In a preferred embodiment, box training assembly 100 of the present invention comprises at least a first dowel member 30. First dowel member 30 comprises a substantially cylindrical shape and is used to provide a secure hand grip in order for a user to perform alternate exercise movements when using only one box member 10. First dowel member 30 can also be used to enable box training assembly 100 to rotate or swivel from front to back (back and forth) during certain other exercise movements, thereby providing a dynamic motion to an exercise movement that activates a user's smaller assisting muscles (synergists) and stabilizer muscles that help a user's main muscle (or primary mover) that is performing work.

Further, in a preferred embodiment, first dowel member 30 comprises at least one groove 33 that is located on each end, 31 and 32, of first dowel member 30. Groove 33 has a relatively smaller diameter than first dowel member 30, thereby allowing groove 33 to sit within circular apertures 23 of first and second side members 11 and 12 of box training assembly 100, and thus, prevent first dowel member 30 from sliding axially through aligned apertures 23 of box training assembly 100 during exercise performance.

In a preferred embodiment, when a user is performing an exercise with first dowel 30 inserted within box member 10, the design of the box training apparatus 100 enables a user to be able to remove or add a weight plate (or any other additional source of resistance) to rod member 24 by way of inner chamber 17 of box member 10. Thus, first dowel 30 does not have to be removed from box member 10 when changing the level of resistance. As a result, this saves a user time during exercise performance and increases ease of use.

Figure 2:
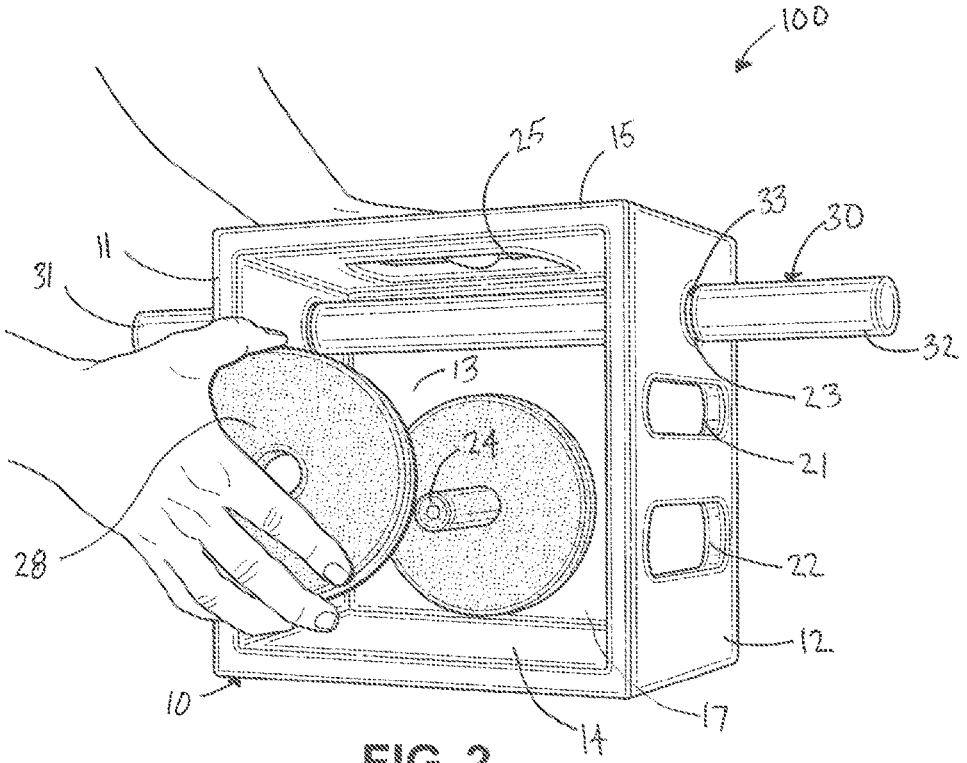
FIG. 2 depicts a front perspective view of a preferred embodiment of a box training apparatus of the present invention with a short dowel member received within aligned circular apertures and at least one weight plate received on a solid rod member.

FIG. 2 depicts a perspective view of at least one weight plate 28 being received within chamber 17 of box training assembly 100 of the present invention. Box member 10 comprises first 11 and second 12 side members, and back member 13 connected to top member 15 and base member 14, thereby cooperating to form chamber 17. First side member 11 and second side member 12 each have aligned apertures 23 and first and second elongate slots 21 and 22 for use in providing a variety of different hand grips for a user. A rigid rod member 24 extends in a relatively perpendicular direction from back member 13 into chamber 17. Rigid rod member 24 enables a user to add at least one weight plate(s) 28 for a variety of strength levels, thereby allowing for a system of progressive adjustment in weight resistance. As illustrated in FIG. 2, in a preferred embodiment, a user can easily and efficiently add one or more weight plates 28 onto rigid rod member 24 within opening 17 of box member 10, while short dowel member 30 is already positioned into place (i.e., received within aligned apertures 23).

Figure 3:
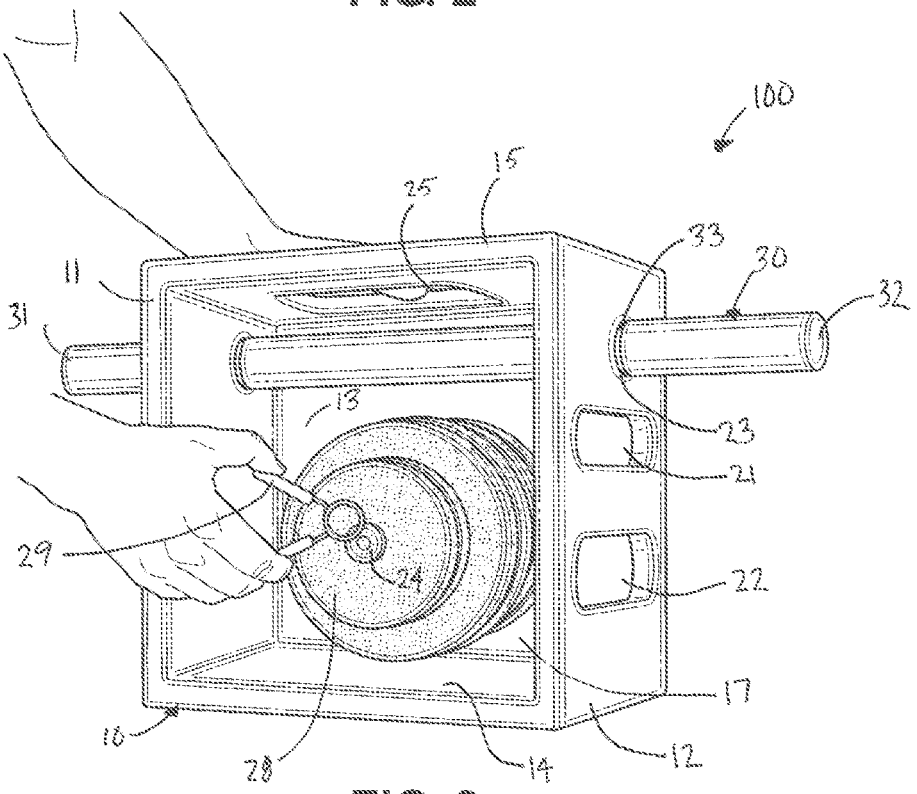
FIG. 3 depicts a front perspective view of a preferred embodiment of a box training apparatus of the present invention with a short dowel member received within aligned circular bores and a clamp being installed to secure weight plates on a solid rod member within said box training apparatus.

FIG. 3 depicts a perspective view of a clamp member 29 being received within chamber 17 of box member 10 and positioned on rod member 24 of box training assembly 100 of the present invention. In a preferred embodiment, clamp member 29 can be used to secure and hold at least one weight plate(s) 28 in place, while said weight plate 28 is located within chamber 17 of box member 10 of the present invention. Clamp member 29 is slidably placed over rod member 24 and locked in place, thereby beneficially holding weight plate 28 in place within box member 10 while a user is performing an exercise movement.

Figure 4:
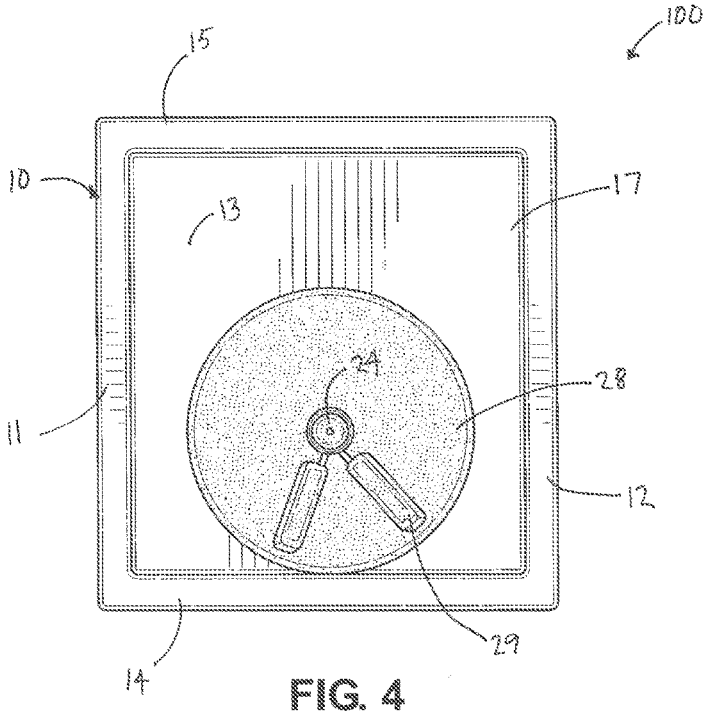
FIG. 4 depicts a front view of a preferred embodiment of a box training apparatus of the present invention with at least one weight plate and a clamp positioned on a solid rod member within said box training apparatus.

FIG. 4 depicts an end view of box training system assembly 100 of the present invention comprising at least one weight plate 28 and clamp member 29. Box member 10 comprises first 11 and second 12, side members, as well as back member 13, connected to top member 15 and base member 14, thereby cooperating to form chamber 17. Rigid rod member 24 extends outwardly in a perpendicular direction from back member 13 into chamber 17. Weight plate 28 is inserted into chamber 17 and received on rod member 24, wherein clamp 29 beneficially secures weight plate 28 on said rod member 24.

Figure 5:
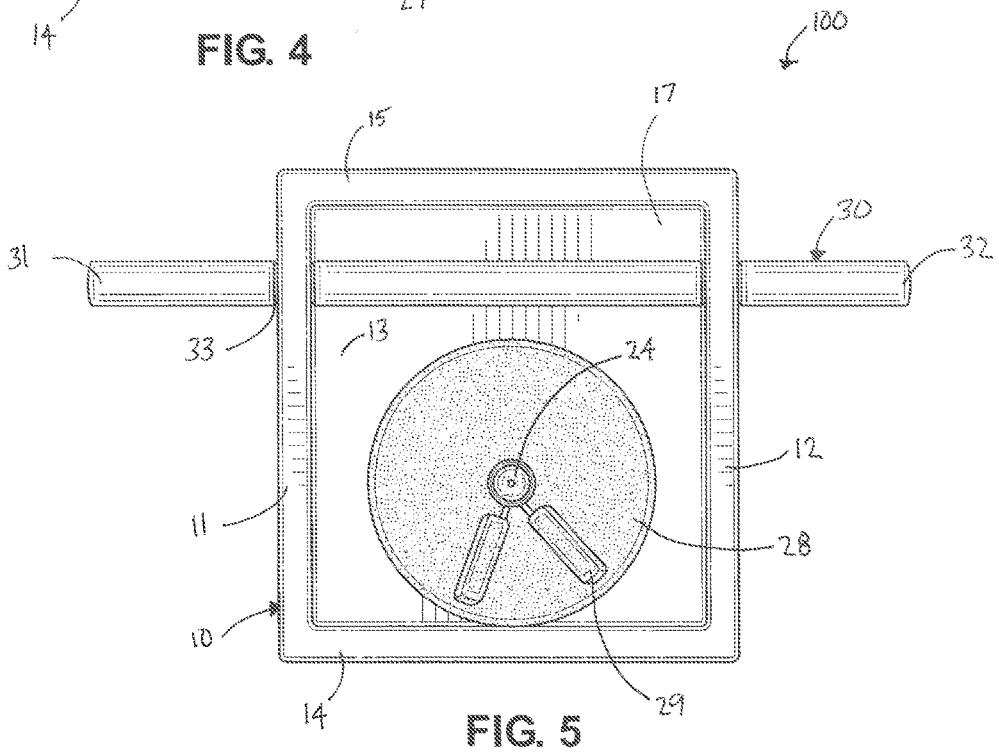
FIG. 5 depicts a front view of a preferred embodiment of a box training system apparatus of the present invention with a short dowel member received within aligned circular apertures and at least one weight plate and a clamp positioned on a solid rod member within said box training system apparatus.

FIG. 5 depicts an end view of box training assembly 100 of the present invention comprising at least one weight plate 28, clamp member 29, and first dowel member 30. Box member 10 comprises first 11 and second 12 side members attachably connected to top member 15, base member 14 and back member 13, thereby cooperating to form chamber 17. Rigid rod member 24 extends in a relatively perpendicular direction from back member 13 into chamber 17. Weight plate 28 is received on rod member 24 and secured in place using clamp member 29.

Still referring to FIG. 5, box training assembly 100 comprises first dowel member 30. First dowel member 30 comprises a substantially cylindrical shape and is used to provide a secure hand grip in order for a user to perform alternate exercise movements when using one box member 10 per hand. First dowel member 30 comprises a recessed groove 33 on first end 31 and second end 32 of first dowel member 30, wherein groove 33 has a relatively smaller diameter than first dowel member 30. First dowel member 30 is received within aligned apertures 23 on first side member 11 and second side member 12 of box member 10, thereby allowing groove 33 to sit within circular aperture 23 on first side member 11 and second side member 12 of box 10 and thus, prevent first dowel member 30 from axially sliding through box 10, particularly during exercise performance.

Figure 6:
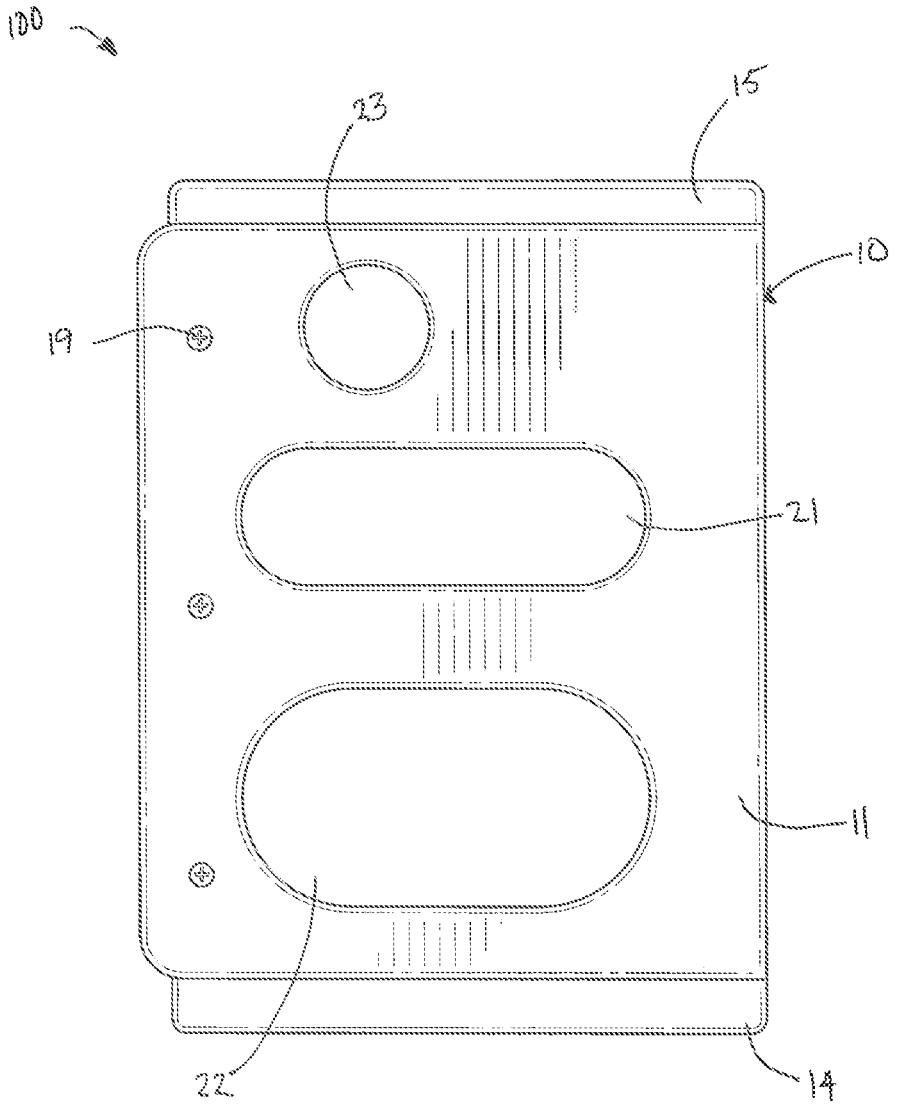
FIG. 6 depicts a side view of a preferred embodiment of a box training apparatus of the present invention.

FIG. 6 depicts a side view of box training assembly 100 of the present invention generally comprising first side member 11. First side member 11 is attachably connected to back member 13 via bolt(s) 19, or other fastener or attachment means, wherein first side member 11 and back member 13 are oriented in a substantially perpendicular configuration. Further, first side member 11 comprises circular aperture 23, first hand grip 21, and second hand grip 22. Although not depicted in FIG. 6, circular aperture 23 is designed and positioned to allow a dowel member to be slidably received through circular aperture 23, thereby creating an additional means to grasp box training assembly 100 for a particular exercise movement. Additionally, as depicted in FIG. 6, circular aperture 23 is positioned toward a base edge of first side member 11, thereby allowing a user to hold box member 10 (when a dowel member is inserted) relatively closer to his or her body, thus permitting a more natural and anatomically advantageous standing position for a human body.

Still referring to FIG. 6, first side member 11 comprises first hand grip slot 21 that is relatively smaller than second hand grip slot 22, thereby allowing a user's fingers to fit comfortably into a space of the relatively smaller elongate slot of first hand grip slot 21. Additionally, first side member 11 comprises second hand grip slot 22 that is relatively larger than first hand grip slot 21, thereby allowing a user's thumb and palm to fit comfortably into a space of the relatively larger elongate slot 22 in order for a user's wrist to be in a substantially straight line alignment with respect to said user's forearm.

Although not shown in FIG. 6, it is to be observed that second side member 12 can comprise a substantially identical configuration as first side member 11 having circular aperture 23, first hand grip slot 21, and second hand grip slot 22, thereby providing a mirror image of first side member 11 and aperture(s)/slot(s) thereof.

Figure 7:
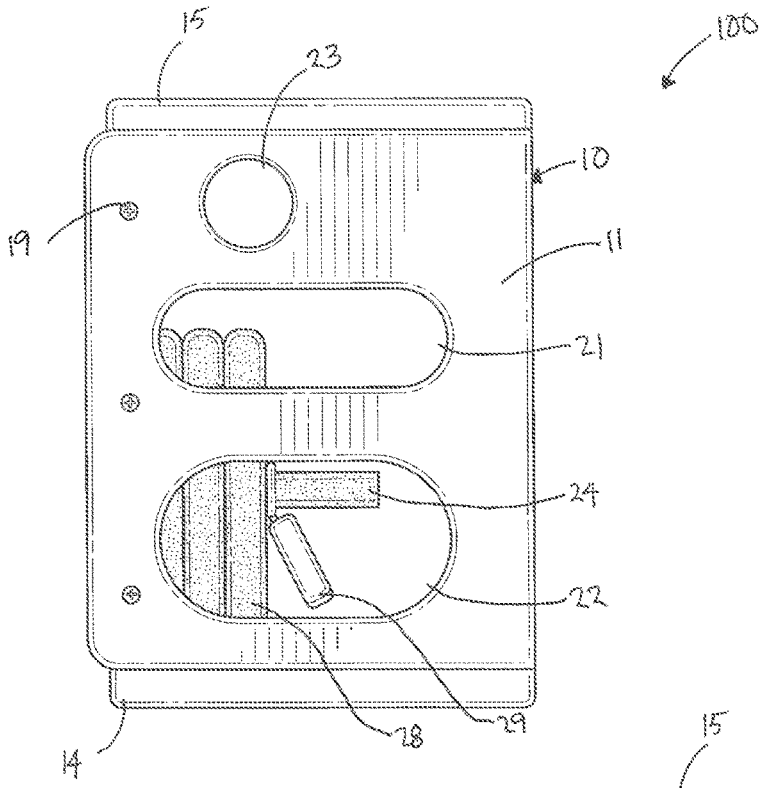
FIG. 7 depicts a side view of a preferred embodiment of a box training apparatus of the present invention with multiple weight plates and a clamp positioned on a solid rod member within said box training apparatus.

FIG. 7 depicts a side view of box training assembly 100 of the present invention comprising at least one weight plate 28 and clamp member 29 received within chamber 17 of box member 10. First side member 11 is attachably connected to back member 13 and has circular aperture 23, first hand grip slot 21, and second hand grip slot 22. Rigid rod member 24 extends in a substantially perpendicular direction from back member 13 into chamber 17. Weight plate 28 is positioned within chamber 17 and received on rod member 24, wherein clamp 29 beneficially secures weight plate 28 in place on said rod member 24.

Although not visible in FIG. 7, it is to be observed that second side member 12 comprises a substantially similar configuration as first side member 11 having circular aperture 23, first hand grip slot 21, and second hand grip slot 22, thereby providing a mirror image of first side member 11 and aperture(s)/slot(s) thereof.

Figure 8:
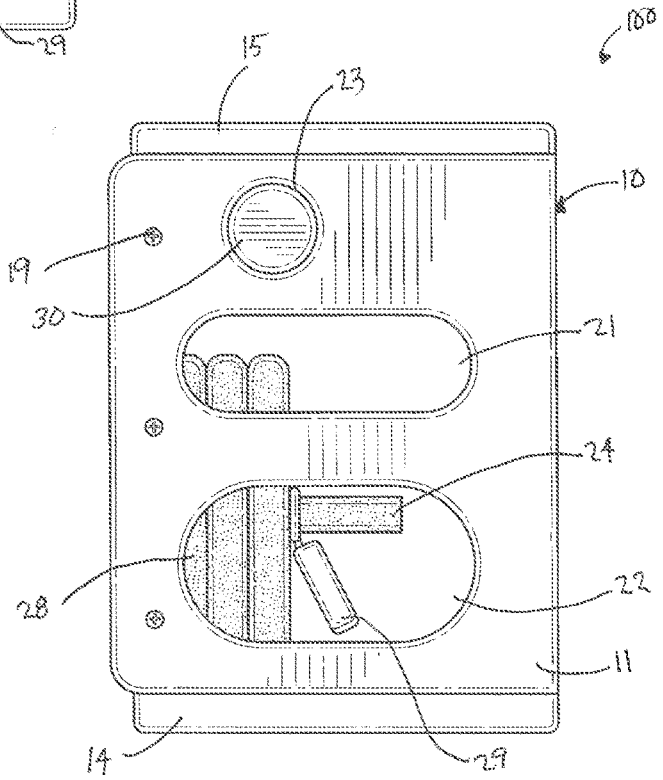
FIG. 8 depicts a side view of a preferred embodiment of a box training system apparatus of the present invention with a short dowel member received within aligned circular apertures and multiple weight plates and a clamp positioned on a solid rod member within said box training apparatus.

FIG. 8 depicts a side view of box training assembly 100 of the present invention comprising first dowel member 30 and at least one weight plate 28 and clamp member 29 received within box member 10. First side member 11 is connected to back member 13 and includes circular aperture 23, first hand grip slot 21, and second hand grip slot 22. Rigid rod member 24 extends in a substantially perpendicular direction from back member 13 into chamber 17. Weight plate 28 is received on rod member 24, and clamp 29 beneficially secures weight plate 28 in place on said rod member 24.

Still referring to FIG. 8, first dowel member 30 is received within circular aperture 23 of first side member 11 of box member 10, thereby allowing groove 33 to sit within circular aperture 23 on first side member 11 of box member 10, (although not depicted in FIG. 8) and, thus, prevent first dowel member 30 from axially sliding through box member 10.

Figure 9:
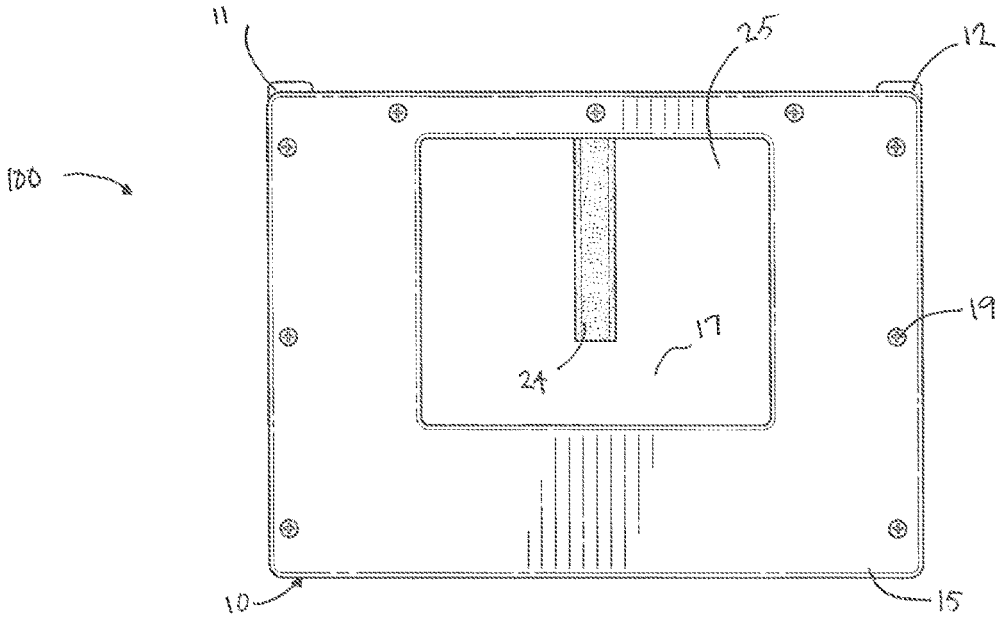
FIG. 9 depicts a top view of a preferred embodiment of a box training apparatus of the present invention.

FIG. 9 depicts a top view of box training assembly 100 of the present invention generally comprising top member 15 of box member 10. Top member 15 is connected to first 11 and second 12 side members and back member 13 via bolts 19 and includes a relatively square-shaped opening 25 extending through said top member 15. Opening 25 allows a user to be able to reach his or her hand through top member 15 of box member 10 into chamber 17. Additionally, opening 25 allows a user to be able to easily switch box member 10 from one hand to another hand by allowing both hands to fit into opening 25 simultaneously during the exchange. In this manner, a user can grasp a dowel member such as dowel member 30 (although not illustrated in FIG. 9), and ultimately, box member 10. As a result, top member 15 with opening 25 provides a user an additional means of grasping box training assembly 100 of the present invention, thus providing for a variety of additional exercise movements.

Figure 10:
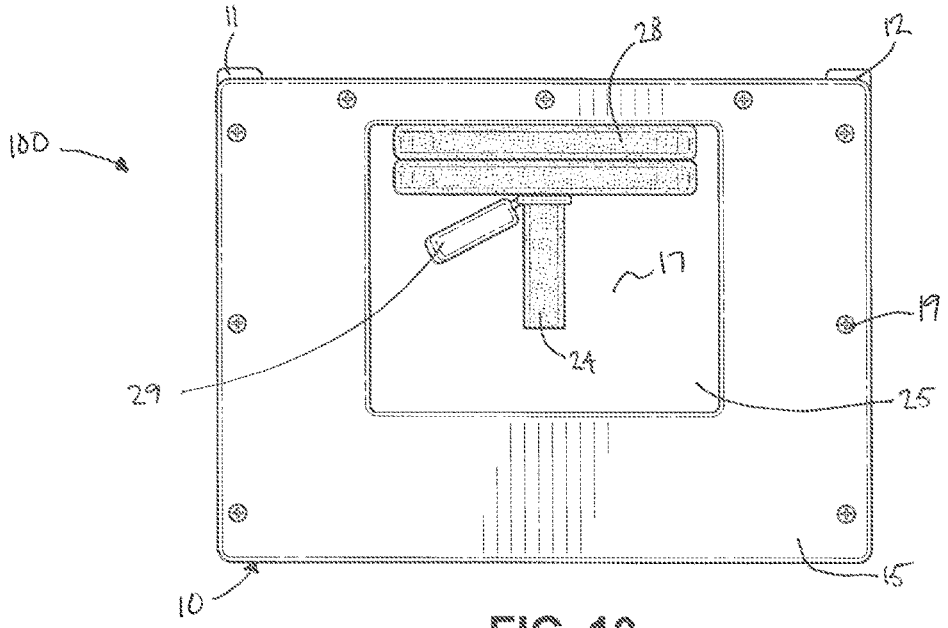
FIG. 10 depicts a top view of a preferred embodiment of a box training apparatus of the present invention with multiple weight plates and a clamp positioned on a solid rod member within said box training apparatus.

FIG. 10 depicts top view of box training assembly 100 of the present invention comprising at least one weight plate 28 and clamp member 29 received within box member 10. Top member 15 is attachably connected to first side 11 and second sides 12 and back member 13 via bolts 19 and includes a relatively square-shaped opening 25. Rigid rod member 24 extends in a substantially perpendicular direction from back member 13 into chamber 17 of box member 10. Weight plate 28 is received on rod member 24 and secured in place using clamp 29.

Figure 11:
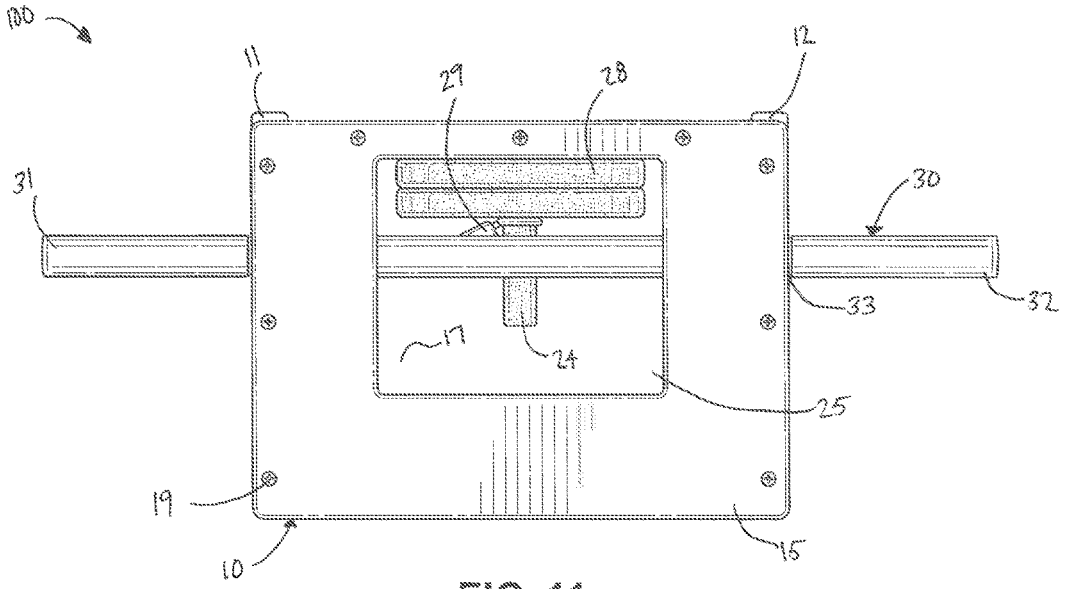
FIG. 11 depicts a top view of a preferred embodiment of a box training apparatus of the present invention with a short dowel member received within aligned circular slots and multiple weight plates and a clamp positioned on a solid rod member within the present invention.

FIG. 11 depicts top view of box training assembly 100 of the present invention comprising first dowel member 30 and at least one weight plate 28 and clamp member 29 received within chamber 17 of box member 10. Top member 15 has opening 25, wherein opening 25 allows a user to reach into and grasp items in chamber 17. Still referring to FIG. 11, rigid rod member 24 extends in a substantially perpendicular direction from back member 13 into chamber 17 of box member 10. Weight plate 28 is received on rod member 24 and clamp 29 beneficially secures weight plate 28 on rod 24.

Figure 12:
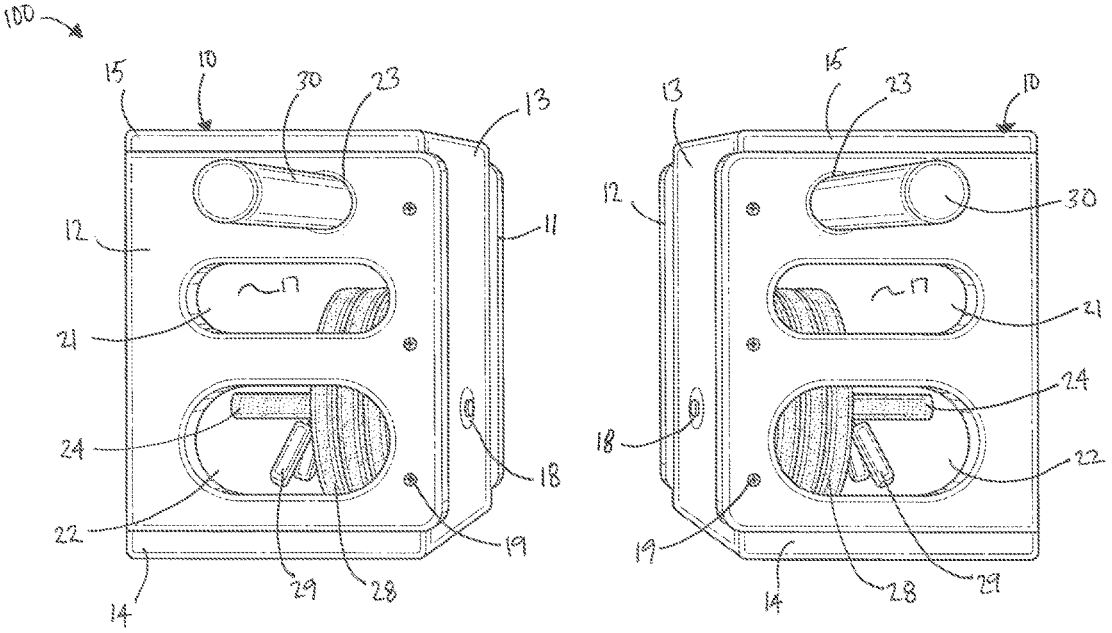
FIG. 12 depicts a side view of two box training members, each having a short dowel member received within aligned circular apertures and multiple weight plates and a clamp positioned on a solid rod member within each of said box members.

FIG. 12 depicts a perspective view of two box training assemblies 100, each comprising a first dowel member 30 received within aligned circular apertures 23. Weight plates 28 and clamp 29 are received on each rod member 24 within each chamber 17.

Figure 13:
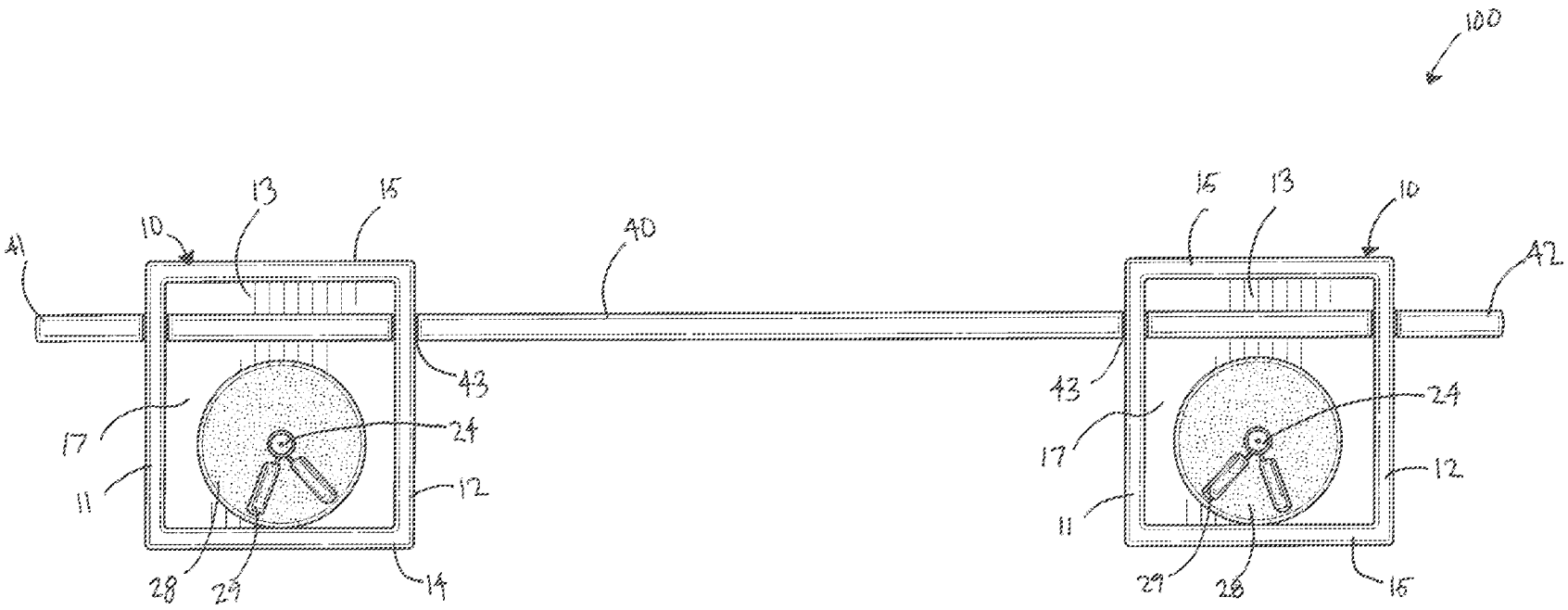
FIG. 13 depicts a front view of two box training members attachably connected by a long dowel member, with each box member having multiple weight plates and a clamp positioned on a solid rod member within each box member.

FIG. 13 depicts an end view of two box training assemblies 100 attachably connected by a second dowel member 40. Each box assembly 100 further comprising at least one weight plate 28 and clamp 29 positioned on each rod member 24 within each chamber 17. Each box member 10 comprises first side 11 and second side 12, and back member 13 attachably connected to top member 15 and base member 14, thereby cooperating to form chamber 17. Rigid rod member 24 extends in a substantially perpendicular direction from back member 13 into chamber 17.

As depicted in FIG. 13, box training assembly 100 comprises second dowel member 40. Second dowel member 40 comprises a substantially cylindrical shape and is used to connect two box members 10 in order to provide an alternate method of exercise training. Thus, second dowel member 40 is used to provide a secure hand grip in order for a user to perform a variety of exercise movements when multiple box training systems are connected.

In a preferred embodiment second dowel member 40 includes groove 43 near first end 41 and second end 42 of second dowel member 40, wherein groove 43 has a relatively smaller diameter than second dowel member 40. Second dowel member 40 is received within aligned circular apertures 23 on first side member 11 and second side member 12 of box member 10, thereby allowing groove 43 to sit within said circular apertures 23 on first and second side members 11 and 12 of box 10 and, thus, prevent second dowel member 40 from axially sliding through box member 10 during exercise performance.

In a preferred embodiment, when a user is performing an exercise with second dowel member 40 inserted within box member 10, the design of the box training apparatus 100 enables a user to be able to remove or add a weight plate 28 (or any other additional source of resistance) to rod member 24 by way of inner chamber 17 of box member 10. Thus, second dowel 40 does not have to be removed from box member 10 when changing the level of resistance. As a result, this saves a user time during exercise performance and increases ease of use.

Figure 14:
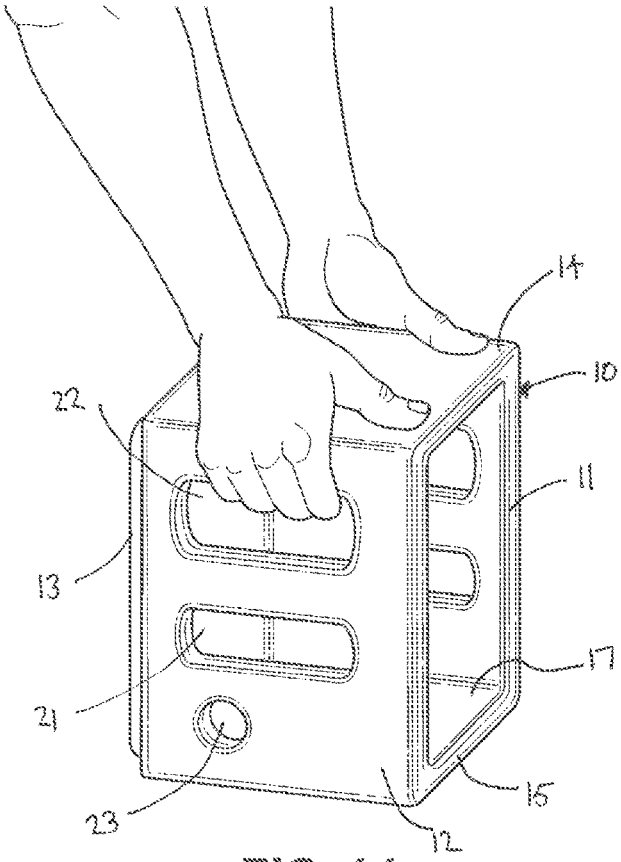
FIG. 14 depicts a side perspective view of a neutral hand grip position of a box training apparatus of the present invention.

FIG. 14 depicts a perspective view of a neutral hand grip position of box training assembly 100 of the present invention. First and second side members 11 and 12 each have a plurality of apertures 20, wherein said apertures 20 can comprise a variety of different configurations (such as, for example, a relatively elongate shape or a relatively circular shape) that allow a user to be able to grip and securely hold said box member 10 in a variety of different positions and using different hand grips.

As illustrated in FIG. 14, first and second side members 11 and 12 each comprise a plurality of elongate slots, or hand grips—a first hand grip slot 21 and a second hand grip slot 22—that allow a user to be able to hold box member 10 in a variety of different positions and using different hand grips. First side member 11 comprises first hand grip slot 21 that is relatively smaller than second hand grip slot 22, thereby allowing a user's fingers to fit comfortably into a space of the relatively smaller elongate slot of first hand grip slot 21. Additionally, first side member 11 comprises second hand grip slot 22 that is relatively larger than first hand grip slot 21, thereby allowing a user's fingers to fit comfortably into a space of relatively larger elongate slot of second hand grip slot 22. Further, although not illustrated in FIG. 14, second hand grip slot 22 can also allow a user's thumb and palm to fit comfortably into a space of the relatively larger elongate slot 22 in order for said user's wrist to be in a substantially straight line alignment with respect to said user's forearm and in order to give user an alternate means of holding box member 10.

Further, in a preferred embodiment, second side member 12 also has first hand grip slot 21 that is relatively smaller than second hand grip slot 22, thereby allowing a user's fingers to fit comfortably within a space of smaller first elongate hand grip slot 21. Second side member 12 also comprises second hand grip slot 22 that is relatively larger than first hand grip slot 21, thereby allowing a user's fingers to fit comfortably into a space of relatively larger oblong slot of second hand grip 22. Further, although not illustrated in FIG. 14, second hand grip slot 22 can also allow a user's thumb and palm to fit naturally into a space of the relatively larger elongate slot 22 in order for said user's wrist to be in a substantially straight line with respect to said user's forearm and in order to give user an alternate means of holding box training assembly 100. Thus, first and second elongate slots 21 and 22 on first and second side members 11 and 12, respectively, allow for a user to hold said box training assembly 100 in a neutral grip hand position, thereby providing safety, efficiency, and exercise versatility to a user during an exercise movement.

Figure 15:
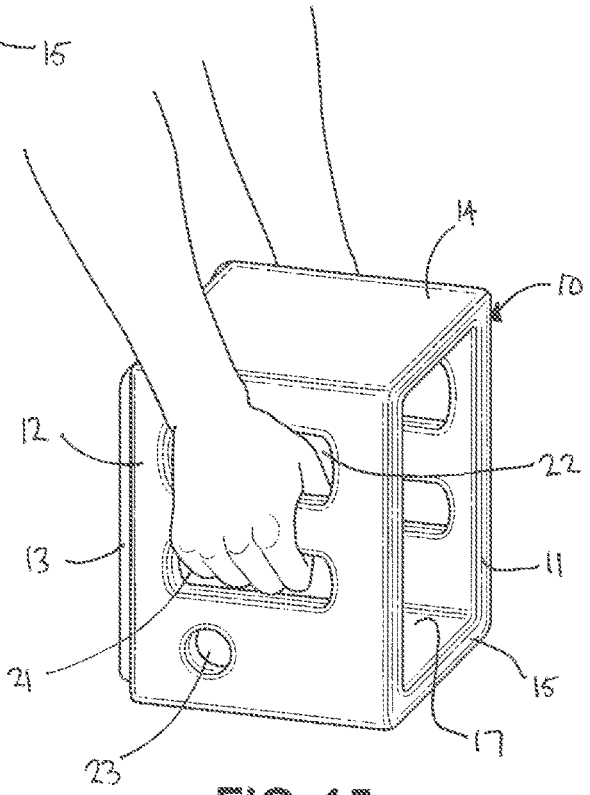
FIG. 15 depicts a side perspective view of an alternate neutral hand grip position of a box training apparatus of the present invention.

FIG. 15 depicts a perspective view of an alternate neutral hand grip position of box training assembly 100. First and second side members 11 and 12 each have a plurality of hand grip openings 20, wherein said openings 20 can comprise a variety of different configurations (such as, for example, a relatively elongate shape or a relatively circular shape) that allow a user to be able to hold said box training system apparatus of the present invention in a variety of different positions and using different hand grips.

As depicted in FIG. 15, first and second side members 11 and 12 each comprise a plurality of elongate slots, or hand grips—a first hand grip slot 21 and a second hand grip slot 22—that allow a user to be able to hold box member 10 in a variety of different positions and using different hand grips. First side member 11 has first hand grip slot 21 that is relatively smaller than second hand grip slot 22, thereby allowing a user's fingers to fit comfortably into a space of the relatively smaller elongate slot of first hand grip slot 21. Additionally, first side member 11 has second hand grip slot 22 that is relatively larger than first hand grip slot 21, thereby allowing a user's thumb and palm to fit comfortably into a relatively larger elongate slot 22 in order for a user's wrist to remain in a substantially straight alignment with respect to said user's forearm.

Figure 16:
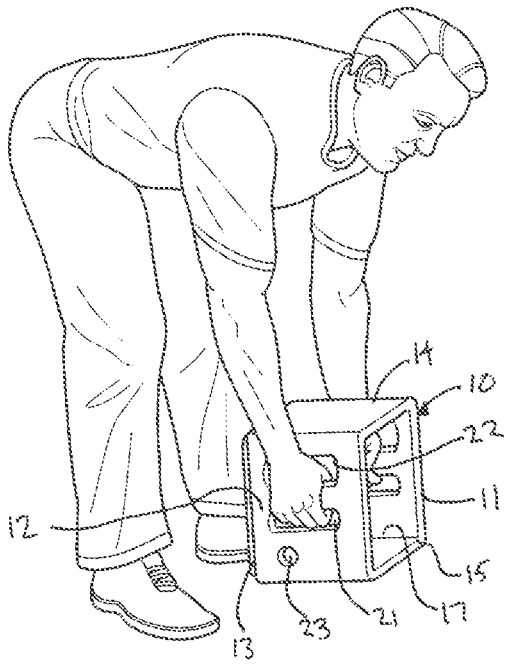
FIG. 16 depicts a side perspective view of a user holding a box training apparatus with a neutral hand grip in a starting position of an exercise movement.
Figure 17:
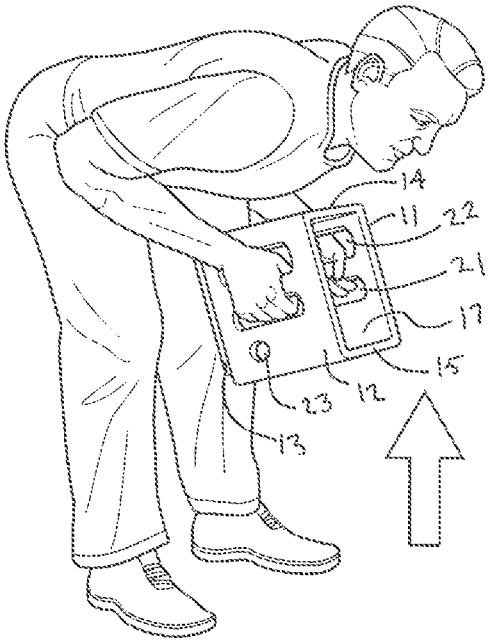
FIG. 17 depicts a side perspective view of a user holding a box training apparatus with a neutral hand grip while performing an exercise movement.

FIG. 16 depicts a side perspective view of a user holding box training assembly 100 with a neutral hand grip in a starting position of an exercise movement. As illustrated in FIG. 16, first hand grip slot 21 of first and second side members 11 and 12 allows user's fingers to fit comfortably through opening of first hand grip slot 21; second hand grip slot 22 of first and second side members 11 and 12 allows user's thumb and palm to fit comfortably through opening of second hand grip slot 22 in order for user's wrist to be in a substantially straight alignment with respect to said user's forearm. Thus, first and second hand grip slots 21 and 22 on first and second side members 11 and 12, respectively, allow for a user to hold said box assembly 100 in a neutral grip hand position, thereby providing safety, efficiency, and exercise versatility to said user during an exercise movement. FIG. 17 depicts a side perspective view of a user holding box training assembly 100 with a neutral hand grip while performing an exercise movement.

Figure 18:
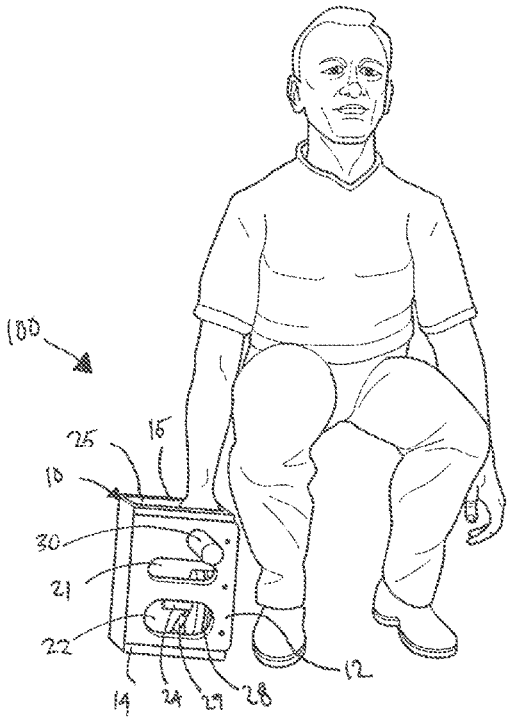
FIG. 18 depicts a front view of a user holding a box training apparatus by first dowel member in a starting position of an exercise movement.
Figure 19:
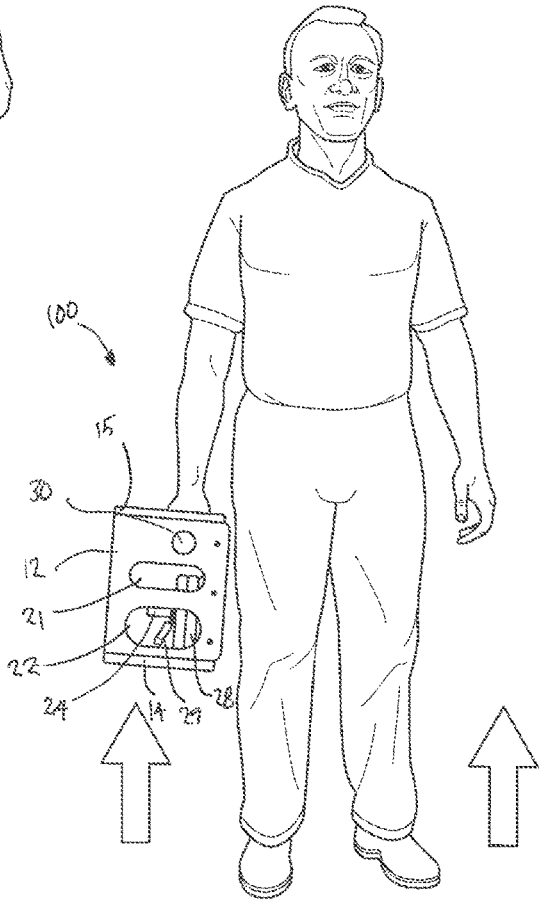
FIG. 19 depicts a front view of a user holding a box training apparatus by first dowel member while performing an exercise movement.

FIG. 18 depicts a front view of a user holding box training assembly 100 by first dowel member 30 in a starting position of an exercise movement. First and second side members 11 and 12 each comprise aligned circular apertures 23, wherein circular apertures 23 are positioned to receive first dowel member 30 through said aligned circular apertures 23. Further, top member 15 has opening 25, thereby allowing a user to reach through opening 25 and grasp first dowel member 30, thus being utilized as an additional hand grip for the box training assembly 100. Additionally, as depicted in FIG. 18, circular aperture 23 is positioned closer to back member 13 thereby allowing a user to hold box assembly 100 of the present invention relatively closer to his or her body, thus mimicking a more natural, anatomically advantageous standing position for a human body. FIG. 19 depicts a front view of a user holding box training assembly 100 by first dowel member 30 and performing an exercise movement.

Figure 20:
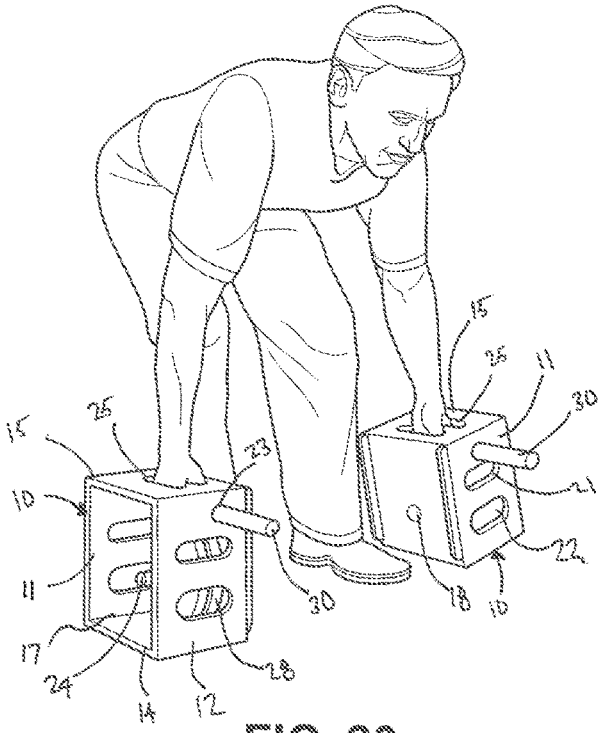
FIG. 20 depicts a side perspective view of a user holding two box training members by a first dowel member in a starting position of an exercise movement.
Figure 21:
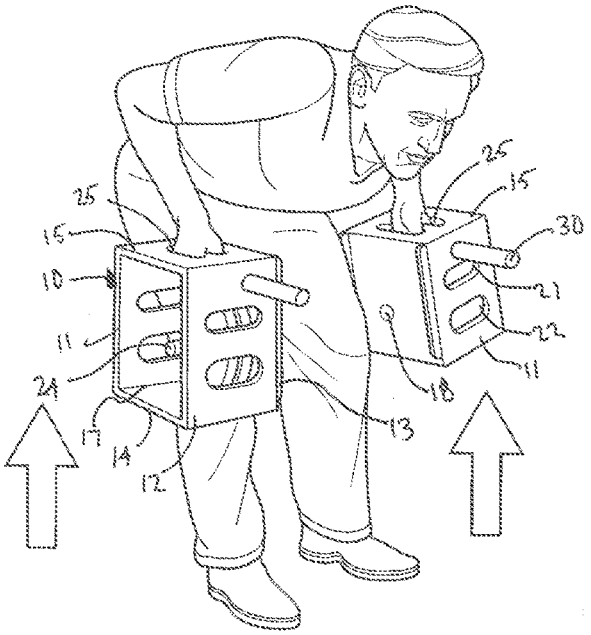
FIG. 21 depicts a side perspective view of a user holding two box training members by a first dowel member and performing an exercise movement.

FIG. 20 depicts a side perspective view of a user holding two box training assembly 100 each by first dowel member 30 in a starting position of an exercise movement. First and second side members 11 and 12 each comprise aligned circular apertures 23, wherein circular apertures 23 are aligned and positioned to allow for first dowel member 30 to be slidably received through said circular apertures 23. Further, top member 15 comprises opening 25, thereby allowing user to reach through opening 25 and grasp first dowel member 30, thus being utilized as an additional hand grip for the box training assembly 100 of the present invention. Additionally, as illustrated in FIG. 20, circular apertures 23 are positioned closer to back member 13 thereby allowing a user to hold two box training assemblies 100 closer to his or her body, thus mimicking a more natural, anatomically advantageous standing position for a human body. As a result, user is able to hold two box training assemblies 100 simultaneously (one in each hand) and perform a variety of different exercises and exercise movements. FIG. 21 depicts a side perspective view of a user holding two box training assembly 100 by first dowel member 30 and performing an exercise movement.

Figure 22:
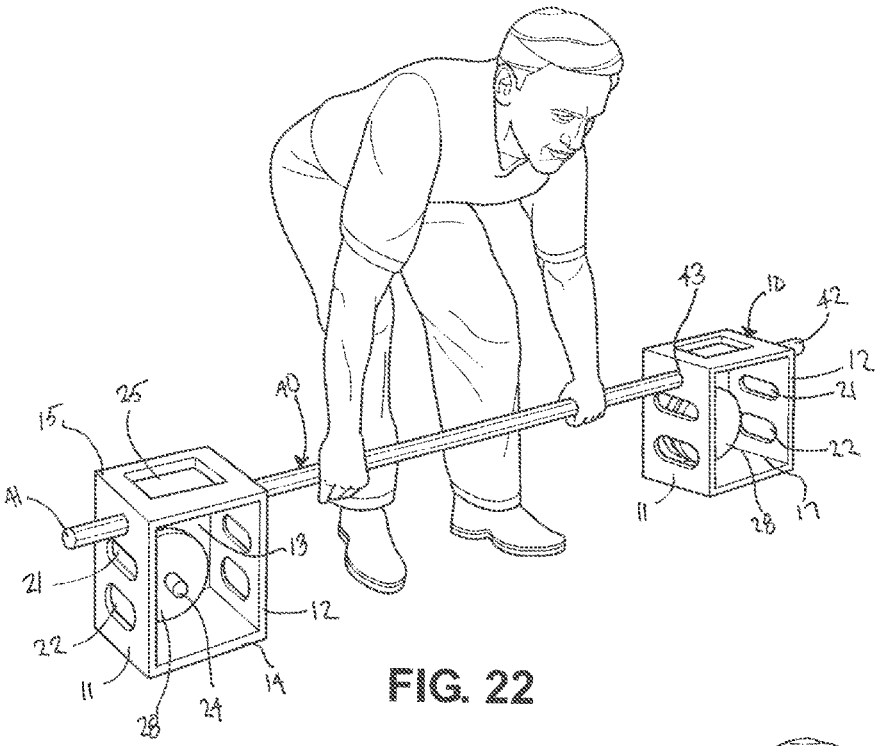
FIG. 22 depicts a side perspective view of a user holding two box training members by a second dowel member in a starting position of an exercise movement.

FIG. 22 depicts a side perspective view of a user holding two box training assemblies 100 by second dowel member 40 in a starting position of an exercise movement.

As depicted in FIG. 22, box training assembly 100 comprises second dowel member 40. Second dowel member 40 comprises a substantially cylindrical shape and is used to connect multiple box members 10 in order to provide an alternate method of exercise training. Thus, second dowel member 40 fits through aligned circular apertures 23 of each box member 10 and provides a secure hand grip in order for a user to perform a variety of different exercise movements when multiple box training assemblies 100 are connected in this manner.

Figure 23:
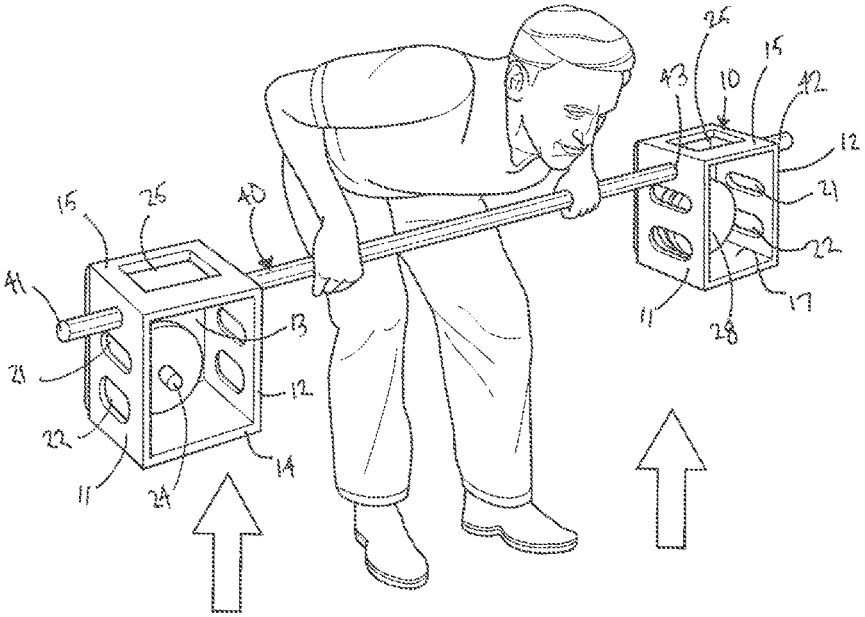
FIG. 23 depicts a side perspective view of a user holding two box training members by a second dowel member while performing an exercise movement.

FIG. 23 depicts a side perspective view of a user holding two box training assemblies 100 using second dowel member 40 while performing an exercise movement. It is to be observed that second dowel member 40 is relatively longer than first dowel member 30. Second dowel member 40 allows for a user to be positioned between multiple weight sources; thus, as a result, second dowel member comprises a length that is necessary to be able to hold and connect multiple box training assemblies 100 simultaneously. Conversely, first dowel member 30 is relatively shorter than second dowel member 40. As a result, first dowel member 30 allows a user to be able to hold only one box training assembly 100 with said first dowel member 30.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An exercise apparatus for fitness and strength training comprising:

a) a box member comprising a first side, a second side, a third side, a fourth side and a back, wherein said first side, said second side, said third side, said fourth side, and said back define an inner chamber, and wherein at least one aperture extends through said first side, at least one aperture extends through said second side and at least one aperture extends through said third side;

b) a rigid rod extending from said back into said chamber, wherein said rigid rod is adapted to receive at least one weight plate;

c) said at least one aperture extending through said first side and said at least one aperture extending through said second side comprise substantially circular and axially aligned apertures; and d) a cylindrical dowel member received within said substantially circular and axially aligned apertures.

2. An exercise apparatus for fitness and strength training comprising:

a) a box member comprising:

(i) a substantially planar third side having at least one aperture extending through said substantially planar third side;

(ii) a substantially planar fourth side oriented substantially parallel to said substantially planar third side;

(iii) a substantially planar first side having at least one aperture extending through said substantially planar first side;

(iv) a substantially planar second side having at least one aperture extending through said substantially planar second side, wherein said substantially planar second side is oriented parallel to said substantially planar first side, (v) a substantially planar back, wherein said substantially planar first side, said substantially planar second side, said substantially planar third side, said substantially planar fourth side, and said substantially planar back define an inner chamber;

b) a rigid rod extending from said substantially planar back into said inner chamber, wherein said rigid rod is adapted to receive at least one weight plate;

c) said at least one aperture extending through said substantially planar first side comprises a first substantially circular hole, said at least one aperture extending through said substantially planar second side comprises a second substantially circular hole, and said first and second substantially circular holes are axially aligned; and d) a cylindrical dowel member received within said substantially circular and axially aligned holes.

3. The exercise apparatus of claim 2, wherein:

a) said substantially circular hole extending through said substantially planar first side is positioned along a width of said substantially planar first side between (i) said substantially planar back, and (ii) a bisector line extending from said substantially planar third side to said substantially planar fourth side along said substantially planar first side; and b) said substantially circular hole extending through said substantially planar second side is positioned along a width of said substantially planar second side between (i) said substantially planar back, and (ii) a bisector line extending from said substantially planar third side to said substantially planar fourth side along said substantially planar second side.

* * * * *